US006115945A

United States Patent [19]

Ellis, III

[11] Patent Number: 6,115,945

[45] **Date of Patent: *Sep. 12, 2000**

[54] SHOE SOLE STRUCTURES WITH DEFORMATION SIPES

[75] Inventor: Frampton E. Ellis, III, Arlington, Va.

[73] Assignee: Anatomic Research, Inc., Arlington, Va.

[ * ] Notice: This patent is subject to a terminal disclaimer.

[21] Appl. No.: 08/162,371

[22] Filed: Dec. 3, 1993

Related U.S. Application Data

[63] Continuation of application No. 07/855,489, Mar. 23, 1992, abandoned, which is a continuation of application No. 07/478,579, Feb. 8, 1990, abandoned.

[51] Int. Cl.[7] ..... A43B 1/10; A43B 13/14; A43B 13/16

[52] U.S. Cl. ..... 36/102; 36/88; 36/103; 36/30 R; 36/25 R; 36/59 R

[58] Field of Search ..... 36/59 R, 59 C, 36/32 R, 28, 29, 114, 116, 12, 107, 108, 76 R, 102, 88, 103, 30 R, 25 R

[56] References Cited

U.S. PATENT DOCUMENTS

| | | | |
|---|---|---|---|
| D. 278,851 | 5/1985 | Austin . | |
| 280,791 | 7/1883 | Brooks . | |
| D. 288,027 | 2/1987 | Tonkel . | |
| 500,385 | 6/1893 | Hall | 36/103 |
| 584,373 | 6/1897 | Kuhn . | |
| 1,870,751 | 8/1932 | Reach . | |
| 2,124,986 | 7/1938 | Pipes | 36/59 C |
| 2,147,197 | 2/1939 | Glidden | 36/3 A X |
| 2,155,166 | 4/1939 | Kraft | 36/59 C |

(List continued on next page.)

FOREIGN PATENT DOCUMENTS

| | | | |
|---|---|---|---|
| 1176458 | 10/1984 | Canada . | |
| 0069083 | 5/1983 | European Pat. Off. . | |
| 1034194 | 7/1953 | France | 36/59 C |
| 1096539 | 6/1955 | France | 36/32 R |
| 1187325 | 9/1959 | France | 36/32 R |
| 1290844 | 3/1969 | Germany . | |
| 3222975 | 2/1983 | Germany | 36/14 |
| 254536 | 8/1927 | Italy | 36/59 C |
| 479755 | 4/1953 | Italy | 36/32 R |
| 1590064 | 8/1990 | U.S.S.R. . | |
| 11890 | 10/1892 | United Kingdom | 36/59 R |
| 9591 | 11/1913 | United Kingdom . | |
| 346771 | 4/1931 | United Kingdom | 36/25 R |
| 471179 | 8/1937 | United Kingdom | 36/59 C |
| 764956 | 1/1957 | United Kingdom . | |
| 2001843 | 2/1979 | United Kingdom | 36/28 |
| 2007081 | 5/1979 | United Kingdom . | |
| 2113072 | 8/1983 | United Kingdom . | |
| 8203754 | 11/1982 | WIPO . | |
| 8303528 | 10/1983 | WIPO | 36/32 R |
| 8304166 | 12/1983 | WIPO . | |
| 8707479 | 12/1987 | WIPO . | |
| 9000358 | 1/1990 | WIPO . | |

OTHER PUBLICATIONS

Runner's World, Nov. 1988, p. 75.
Runner's World, Oct. 1987, p. 60.

*Primary Examiner*—Ted Kavanaugh
*Attorney, Agent, or Firm*—Finnegan, Henderson, Farabow, Garrett & Dunner, L.L.P.

[57] ABSTRACT

A construction for a shoe, particularly an athletic shoe, which includes a sole that conforms to the natural shape of the foot shoe, including the bottom and the sides, when that foot sole deforms naturally by flattening under load while walking or running in order to provide a stable support base for the foot and ankle. Deformation sipes such as slits or channels are introduced in the shoe sole along its long axis, and other axes, to provide it with flexibility roughly equivalent to that of the foot. The result is a shoe sole that accurately parallels the frontal plane deformation of the foot sole, which creates a stable base that is wide and flat even when tilted sideways in extreme pronation or supination motion. In marked contrast, conventional shoe soles are rigid and become highly unstable when tilted sideways because they are supported only by a thin bottom edge.

9 Claims, 8 Drawing Sheets

U.S. PATENT DOCUMENTS

| | | | |
|---|---|---|---|
| 2,162,912 | 6/1939 | Craver . | |
| 2,201,300 | 5/1940 | Prue et al. . | |
| 2,206,860 | 9/1940 | Sperry | 36/59 C |
| 2,251,468 | 8/1941 | Smith . | |
| 2,284,307 | 5/1942 | Sperry . | |
| 2,328,242 | 8/1943 | Witherill | 36/25 R |
| 2,345,831 | 4/1944 | Pierson . | |
| 2,470,200 | 5/1949 | Wallach . | |
| 2,508,392 | 5/1950 | Issaly . | |
| 2,627,676 | 2/1953 | Hack . | |
| 2,757,461 | 8/1956 | Cartmell | 36/59 C |
| 2,922,235 | 1/1960 | Meltzer . | |
| 3,087,262 | 4/1963 | Russell | 36/28 |
| 3,295,230 | 1/1967 | Szerenyi et al. . | |
| 3,732,634 | 5/1973 | Jacobson . | |
| 3,824,716 | 7/1974 | DiPaolo . | |
| 3,834,046 | 9/1974 | Fowler . | |
| 4,059,910 | 11/1977 | Bryden et al. . | |
| 4,281,467 | 8/1981 | Anderie . | |
| 4,302,892 | 12/1981 | Adamik . | |
| 4,309,831 | 1/1982 | Pritt . | |
| 4,449,306 | 5/1984 | Cavanagh . | |
| 4,455,767 | 6/1984 | Bergmans | 36/28 X |
| 4,468,870 | 9/1984 | Sternberg . | |
| 4,505,055 | 3/1985 | Bergmans | 36/18 |
| 4,527,345 | 7/1985 | Lopez Lopez . | |
| 4,542,598 | 9/1985 | Misevich et al. . | |
| 4,547,979 | 10/1985 | Harada et al. . | |
| 4,557,059 | 12/1985 | Misevich et al. . | |
| 4,569,142 | 2/1986 | Askinasi . | |
| 4,570,362 | 2/1986 | Vermonet . | |
| 4,571,852 | 2/1986 | Lamarche et al. | 36/59 C |
| 4,620,376 | 11/1986 | Talarico, II | 36/25 R |
| 4,624,061 | 11/1986 | Wezel et al. . | |
| 4,638,577 | 1/1987 | Riggs . | |
| 4,654,983 | 4/1987 | Graham et al. . | |
| 4,667,423 | 5/1987 | Autry et al. . | |
| 4,715,133 | 12/1987 | Hartjes et al. . | |
| 4,724,622 | 2/1988 | Mills . | |
| 4,724,624 | 2/1988 | Duclos | 36/59 C |
| 4,731,939 | 3/1988 | Parracho et al. . | |
| 4,748,753 | 6/1988 | Ju | 36/127 |
| 4,777,738 | 10/1988 | Giese et al. | 36/59 C |
| 4,782,603 | 11/1988 | Brown | 36/28 |
| 4,783,910 | 11/1988 | Boys, II et al. . | |
| 4,790,083 | 12/1988 | Dufour . | |
| 4,798,010 | 1/1989 | Sugiyama | 36/28 X |
| 4,858,340 | 8/1989 | Pasternak . | |
| 4,864,737 | 9/1989 | Marrello . | |
| 4,864,739 | 9/1989 | Maestri . | |
| 4,876,806 | 10/1989 | Robinson et al. . | |
| 4,876,807 | 10/1989 | Tiitola et al. | 36/14 X |
| 4,878,300 | 11/1989 | Bogaty | 36/28 X |
| 4,887,367 | 12/1989 | Mackness et al. | 36/28 |
| 4,890,398 | 1/1990 | Thomasson . | |
| 4,894,932 | 1/1990 | Harada et al. . | |
| 4,934,073 | 6/1990 | Robinson | 36/25 R |
| 4,937,954 | 7/1990 | Clement . | |
| 4,989,349 | 2/1991 | Ellis, III | 36/25 R |
| 5,012,597 | 5/1991 | Thomasson . | |
| 5,014,449 | 5/1991 | Richard et al. . | |
| 5,025,573 | 6/1991 | Giese et al. . | |
| 5,048,203 | 9/1991 | Kling . | |
| 5,224,810 | 7/1993 | Pitkin . | |
| 5,247,742 | 9/1993 | Kilgore et al. . | |
| 5,317,819 | 6/1994 | Ellis, III | 36/30 R X |
| 5,544,429 | 8/1996 | Ellis, III | 36/31 X |

SHOE SOLE STRUCTURES WITH DEFORMATION SIPES

This application is a continuation of U.S. application Ser. No. 07/855,489 filed Mar. 23, 1992, now abandoned and which is a continuation of U.S. application Ser. No. 07/478,579 filed Feb. 8, 1990, which was abandoned.

BACKGROUND OF THE INVENTION

This invention relates generally to the structure of shoes. More specifically, this invention relates to the structure of athletic shoes. Still more particularly, this invention relates to shoe soles that conform to the natural shape of the foot sole, including the bottom and the sides, when the foot sole deforms naturally during locomotion in order to provide a stable support base for the foot and ankle. Still more particularly, this invention relates to the use of deformation sipes such as slits or channels in the shoe sole to provide it with sufficient flexibility to parallel the frontal plane deformation of the foot sole, which creates a stable base that is wide and flat even when tilted sideways in natural pronation and supination motion.

The applicant has introduced into the art the use of sipes to provide natural deformation paralleling the human foot in pending U.S. application Ser. No. 07/424,509 now abandoned, filed Oct. 20, 1989, and as PCT Application No. PCT/US90/06028, which is comprised verbatim of the '509 application and was published as WO 91/05491 on May 2, 1991. It is the object of this invention to elaborate upon that earlier application to apply its general principles to other shoe sole structures, including those introduced in the applicant's other earlier applications.

By way of introduction, many conventional boat shoes are siped, a fairly archaic term derived from early automotive tire traction techniques which refers specifically to tread structure. As the term applies to shoes, siped shoe soles are provided with parallel slits or channels through portions of the shoe sole bottom, to increase traction for the otherwise typically smooth rubber sole bottom. This concept was originally introduced by Sperry with its old and famous "Topsider" boat shoe model, which incorporated U.S. Pat. Nos. 2,124,986, 2,206,860, and 2,284,307.

The traction sipes in the form of slits or channels run perpendicular to the long axis of the shoe, since slipping is most typical along that long axis coincident to locomotion forwards or backwards. The parallel traction slits typically penetrate to a depth of about a third or slightly more of the boat shoe.

The applicant's invention in the prior application Ser. No. 07/424,509 now abandoned is to use similar sipes such as slits or channels that, however, penetrate through most or even all of the shoe sole, to provide as much flexibility as possible to deform easily, rather than to increase traction. Moreover, the slits or channels of the applicant's prior invention are located on the opposite axis from those in conventional boat shoe soles.

Thus, the applicant's prior invention provides the shoe sole with flexibility roughly equivalent to the foot sole. Such flexibility will allow the shoe sole to parallel the frontal plane deformation of the human foot sole, which naturally creates a stable base that is wide and flat even when the foot is tilted sideways in either normal or extreme pronation and supination. In complete contrast, conventional shoes soles are extremely rigid in the frontal plane and become highly unstable when tilted sideways on their very narrow bottom sole edge.

The inherent instability of existing shoes is caused by a conventional shoe sole that will not deform to provide as much contact with the ground as the foot does naturally. Both conventional heel counters and motion control devices increase the rigidity of the shoe sole and therefore increase the stability problem, creating an unnaturally high and unnecessary level of ankle sprains and chronic overuse injuries.

The prior invention introduced sipes such as additional slits or channels on different axes to provide shoe sole motion paralleling the natural deformation of the moving foot in other planes. In addition, the prior invention provides flexibility to a shoe sole even when the material of which it is composed is relatively firm to provide good support. Without the invention, both firmness and flexibility would continue to be mutually exclusive and could not coexist in the same shoe sole; only a very soft material will allow a conventional shoe sole structure to deform naturally like the foot and such a sole would be highly unsatisfactory in terms of support, protection, and durability.

In addition to the prior pending application indicated above, the applicant has introduced into the art the concept of a theoretically ideal stability plane as a structural basis for shoe sole designs. That concept as implemented into shoes such as street shoes and athletic shoes is presented in pending U.S. applications Ser. No. 07/219,387, filed on Jul. 15, 1988, now U.S. Pat. No. 4,989,349, issued Feb. 5, 1991; Ser. No. 07/239,667, filed on Sep. 2, 1988, now U.S. Pat. No. 5,317,819, issued Jun. 7, 1994; Ser. No. 07/400,714, filed on Aug. 30, 1989 still pending; Ser. No. 07/416,478, filed on Oct. 3, 1989 still pending; Ser. No. 07/463,302, filed on Jan. 10, 1990 still pending; and Ser. No. 07/469,313, filed on Jan. 24, 1990 still pending, as well as in PCT Application No. PCT/US89/03076 filed on Jul. 14, 1989. PCT Application No. PCT/US89/03076, which is generally comprised of the virtually the entire '819 Patent verbatim (FIGS. 1–28) and major portions of the '349 Patent also verbatim (FIGS. 29–37), was published as International Publication Numbers WO 90/00358 on Jan. 25, 1990; PCT Application No. PCT/US90/04917, which is comprised verbatim of the '714 application, except for FIGS. 13–15 (which were published as FIGS. 38–40 of WO 90/00358), was published as WO 91/03180 on Mar. 21, 1991; PCT Application No. PCT/US90/05609, which is comprised verbatim of the '478 application, was published as WO 91/04683 on Apr. 18, 1991; PCT Application No. PCT/US91/00028, which is comprised verbatim of the '302 application, was published as WO 91/10377 on Jul. 25, 1991; PCT Application No. PCT/US91/00374, which is comprised verbatim of the '313 application, was published as WO 91/11124 on Aug. 8, 1991. The purpose of the theoretically ideal stability plane as described in these applications was primarily to provide a neutral design that allows for natural foot and ankle biomechanics as close as possible to that between the foot and the ground, and to avoid the serious interference with natural foot and ankle biomechanics inherent in existing shoes.

The applicant's prior application on the sipe invention and the elaborations in this application are modifications of the inventions disclosed and claimed in the earlier applications and develop the application of the concept of the theoretically ideal stability plane to other shoe structures. The theoretically ideal stability plane 51 is defined as the plane of the surface of the bottom of the shoe sole 31, wherein the shoe sole conforms to the natural shape of the foot, particularly the sides, and has a constant thickness in frontal plane cross sections. Accordingly, it is a general object of the new invention to elaborate upon the application of the principle of the theoretically ideal stability plane to other shoe structures.

It is an overall objective of this application to show additional forms and variations of the general deformation sipes invention disclosed in the '509 application, particularly showing its incorporation into the other inventions disclosed in the applicant's other applications. It is another objective of the invention to provide flexibility to a shoe sole even when the material of which it is composed is relatively firm to provide good support: without the invention, both firmness and flexibility would continue to be mutually exclusive and could not coexist in the same shoe sole.

These and other objects of the invention will become apparent from a detailed description of the invention which follows taken with the accompanying drawings.

BRIEF DESCRIPTION OF THE DRAWINGS

FIG. 1 shows that shoe when tilted 20 degrees outward, at the normal limit of ankle inversion.

DETAILED DESCRIPTION OF THE PREFERRED EMBODIMENTS

Figure 1:
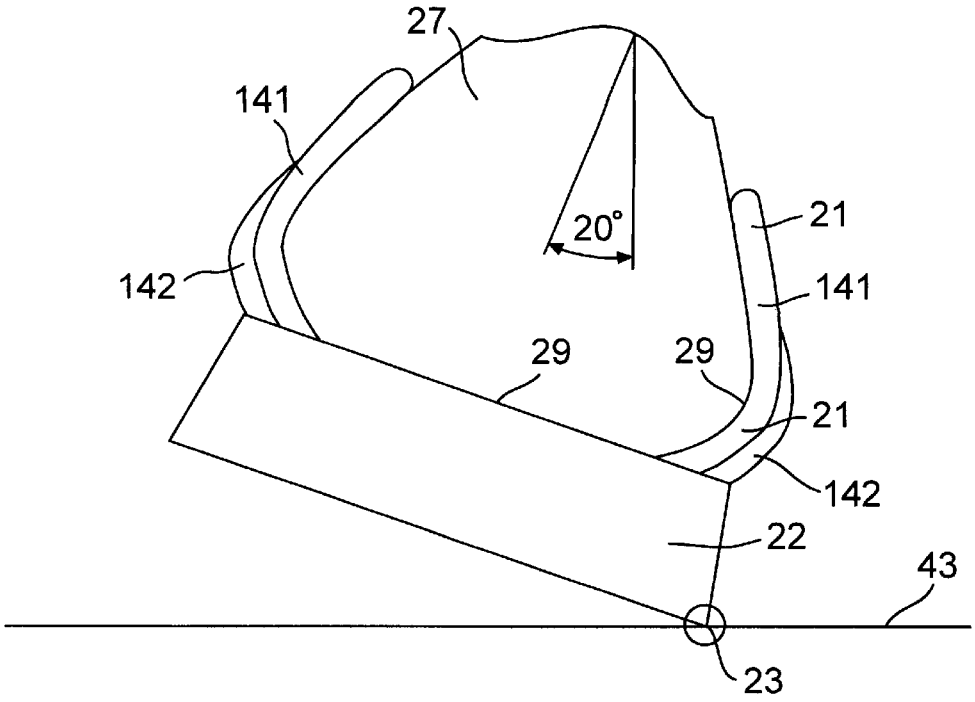
FIG. 1 (PRIOR ART)
FIG. 1 shows, in frontal plane cross section at the heel portion of a shoe, a conventional modern running shoe with rigid heel counter and reinforcing motion control device and a conventional shoe sole.

FIG. 1 shows a conventional athletic shoe in cross section at the heel, with a conventional shoe sole 22 having essentially flat upper and lower surfaces and having both a strong heel counter 141 and an additional reinforcement in the form of motion control device 142. FIG. 1 specifically illustrates when that shoe is tilted outward laterally in 20 degrees of inversion motion at the normal natural limit of such motion in the barefoot. FIG. 1 demonstrates that the conventional shoe sole 22 functions as an essentially rigid structure in the frontal plane, maintaining its essentially flat, rectangular shape when tilted and supported only by its outside, lower corner edge 23, about which it moves in rotation on the ground 43 when tilted. Both heel counter 141 and motion control device 142 significantly enhance and increase the rigidity of the shoe sole 22 when tilted. All three structures serve to restrict and resist deformation of the shoe sole 22 under normal loads, including standing, walking and running. Indeed, the structural rigidity of most conventional street shoe materials alone, especially in the critical heel area, is usually enough to effectively prevent deformation.

Figure 2:
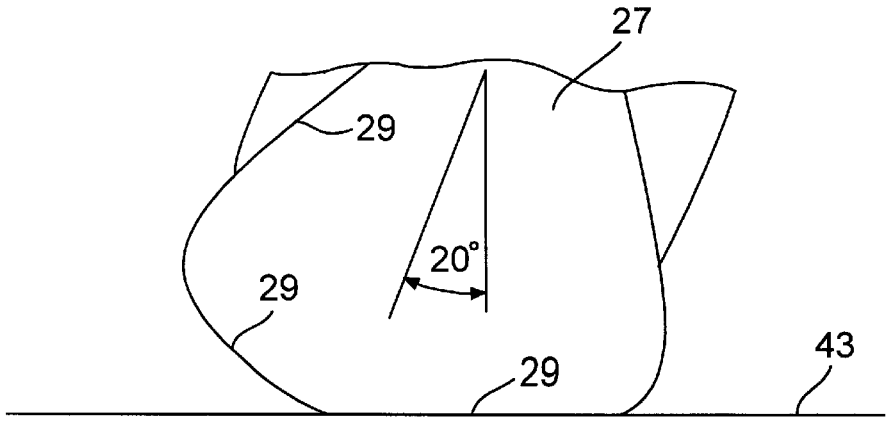
FIG. 2 shows, in frontal plane cross section at the heel, the human foot when tilted 20 degrees outward, at the normal limit of ankle inversion.

FIG. 2 shows a similar heel cross section of a barefoot tilted outward laterally at the normal 20 degree inversion maximum. In marked contrast to FIG. 1, FIG. 2 demonstrates that such normal tilting motion in the barefoot is accompanied by a very substantial amount of flattening deformation of the human foot sole, which has a pronounced rounded contour when unloaded, as will be seen in foot sole surface 29 later in FIG. 11.

FIG. 2 shows that in the critical heel area the barefoot maintains almost as great a flattened area of contact with the ground when tilted at its 20 degree maximum as when upright, as seen later in FIG. 3. In complete contrast, FIG. 1 indicate clearly that the conventional shoe sole changes in an instant from an area of contact with the ground 43 substantially greater than that of the barefoot, as much as 100 percent more when measuring in roughly the frontal plane, to a very narrow edge only in contact with the ground, an area of contact many times less than the barefoot. The unavoidable consequence of that difference is that the conventional shoe sole is inherently unstable and interrupts natural foot and ankle motion, creating a high and unnatural level of injuries, traumatic ankle sprains in particular and a multitude of chronic overuse injuries.

This critical stability difference between a barefoot and a conventional shoe has been dramatically demonstrated in the applicant's new and original ankle sprain simulation test described in detail in the applicant's earlier U.S. patent application Ser. No. 07/400,714, filed on Aug. 30, 1989, still pending, and was referred to also in both of his earlier applications previously noted here.

Figure 3A:
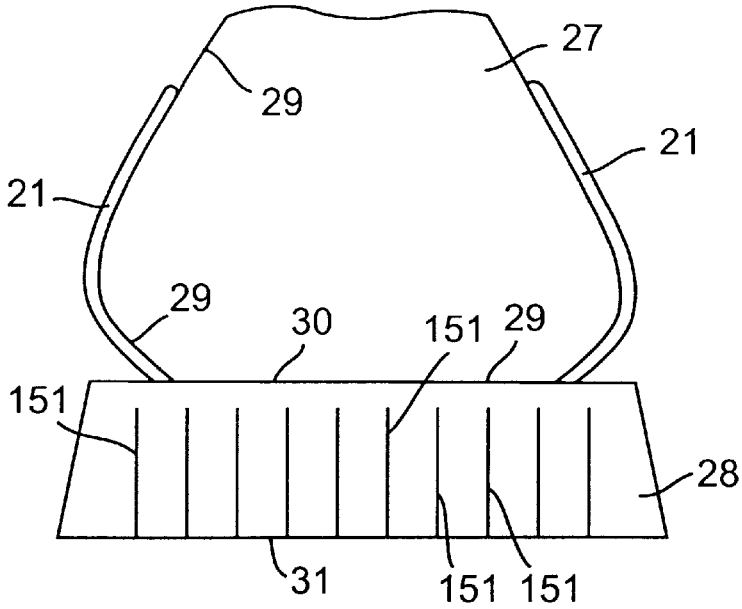
FIG. 3 shows, in frontal plane cross section at the heel portion, the applicant's prior invention in pending U.S. application Ser. No. 07/424,509, filed Oct. 20, 1989 now abandoned, of a conventional shoe sole with sipes in the form of deformation slits aligned in the vertical plane along the long axis of the shoe sole.
FIGS. 3B–3E show close-up sections of the shoe sole to show various forms of sipes, including both slits and channels.

FIG. 3A shows, in frontal plane cross section at the heel, the applicant's prior invention of pending U.S. application Ser. No. 07/424,509, filed Oct. 20, 1989 now abandoned, the most clearcut benefit of which is to provide inherent stability similar to the barefoot in the ankle sprain simulation test mentioned above.

It does so by providing conventional shoe soles with sufficient flexibility to deform in parallel with the natural deformation of the foot. FIG. 3A indicates a conventional shoe sole into which have been introduced deformation slits 151, also called sipes, which are located optimally in the vertical plane and on the long axis of the shoe sole, or roughly in the sagittal plane, assuming the shoe is oriented straight ahead.

The deformation slits 151 can vary in number beginning with one, since even a single deformation slit offers improvement over an unmodified shoe sole, though obviously the more slits are used, the more closely can the surface of the shoe sole coincide naturally with the surface of the sole of the foot and deform in parallel with it. The space between slits can vary, regularly or irregularly or randomly. The deformation slits 151 can be evenly spaced, as shown, or at uneven intervals or at unsymmetrical intervals. The optimal orientation of the deformation slits 151 is coinciding with the vertical plane, but they can also be located at an angle to that plane.

The depth of the deformation slits 151 can vary. The greater the depth, the more flexibility is provided. Optimally, the slit depth should be deep enough to penetrate most but not all of the shoe sole, starting from the bottom surface 31, as shown in FIGS. 3A and 3B, a close-up section of the shoe sole.

Figure 3B:
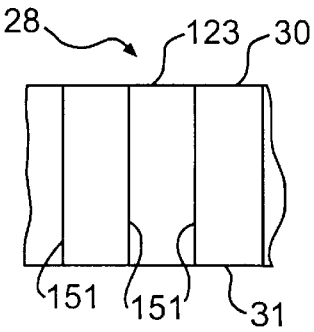

FIG. 3B shows the simplest technique of cutting slits into existing conventional shoe sole designs.

Figure 3C:
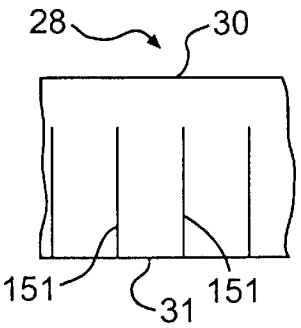
Figure 3D:
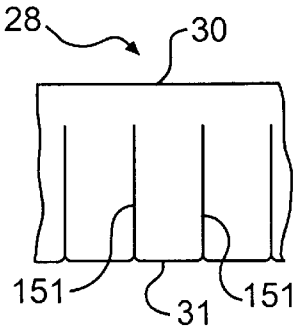

Near the bottom surface they can be beveled, as shown in FIG. 3D, also a close-up section of the shoe sole. The size and angle of the beveled surface can vary, though 45 degrees is probably optimal.

The deformation slits can be enlarged to channels 151, also known as sipes, or separate removed sections from the bottom of the shoe sole, as shown in FIG. 3E, again a close-up section of the shoe sole. Such channels 151 would typically be used optimally with the injection molding of shoe soles, since they could be cast at the same time as the shoe sole itself in one step. The size of the channels 151 can vary, from only slight enlargements of slits to much larger. They can be patterned in any way, including regular or irregular or random and can be defined by straight, curved, or irregular lines.

The deformation slits 151 can penetrate completely through the shoe sole, as shown in FIG. 3B the final shoe sole close-up section shown, as long as they are firmly attached to a flexible layer 123 of cloth, of woven or compressed fibers that possess good strength, flexibility and durability characteristics, like nylon or kevlar, or leather. This concept was introduced in FIG. 28 of pending U.S. application Ser. No. 07/239,667 now U.S. Pat. No. 5,317,819. The layer 123 can be preattached to the shoe sole before assembly with the shoe upper, or the shoe upper can provide suitable cloth in the case of a slip-lasted shoe. In a board-lasted shoe, the conventional paper fiber board would not be very satisfactory either in terms of flexibility or durability under repeated flexion and would preferably be upgraded to a flexible and durable board made of woven or compressed fiber, as described above, impregnated with a flexible binding material if necessary.

Figure 3E:
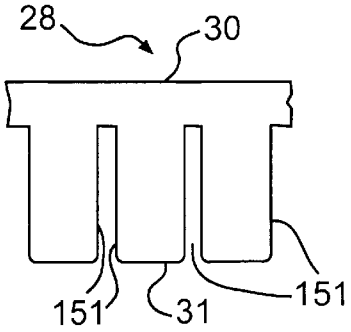

The construction of deformation slits shown in FIG. 3E provides the maximum amount of deformation flexibility. The deformation slit modifications shown in FIGS. 3C and 3D can also be applied to the FIG. 3E approach.

A key element in the applicant's invention is the absence of either a conventional rigid heel counter or conventional rigid motion control devices, both of which significantly reduce flexibility in the frontal plane, as noted earlier in FIG. 1, in direct proportion to their relative size and rigidity. If not too extensive, the applicant's prior sipe invention still provide definite improvement.

Finally, it is another advantage of the invention to provide flexibility to a shoe sole even when the material of which it is composed is relatively firm to provide good support; without the invention, both firmness and flexibility would continue to be mutually exclusive and could not coexist in the same shoe sole.

Figure 4:
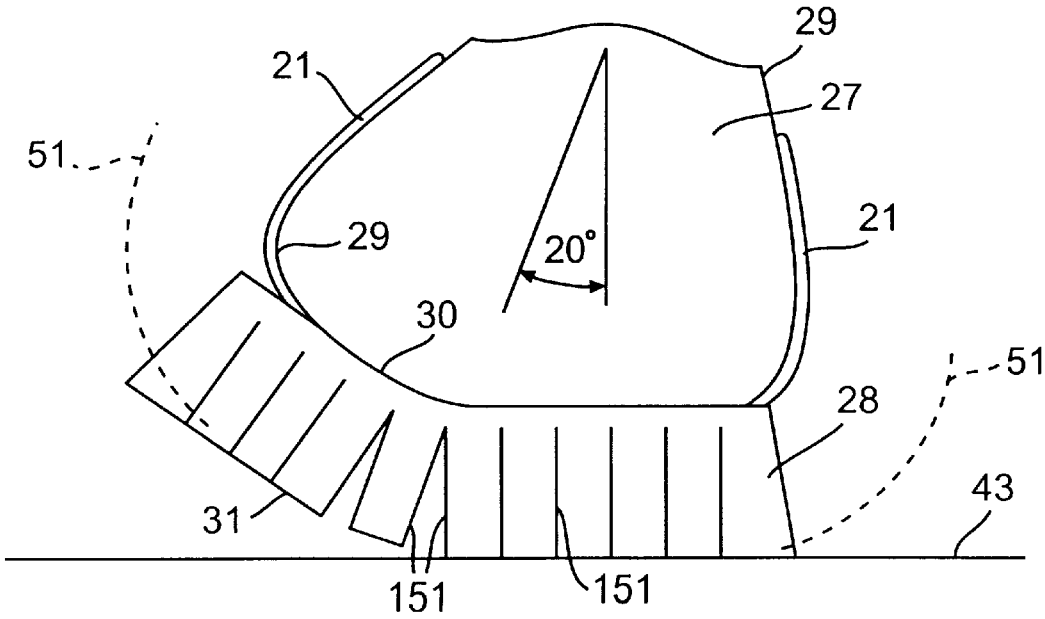
FIG. 4 is a view similar to FIG. 3, but with the shoe tilted 20 degrees outward, at the normal limit of ankle inversion, showing that the conventional shoe sole, as modified according to pending U.S. application Ser. No. 07/424,509, filed Oct. 20, 1989 now abandoned, can deform in a manner paralleling the wearer's foot, providing a wide and stable base of support in the frontal plane.

FIG. 4 shows, in frontal plane cross section at the heel, the applicant's prior invention of pending U.S. application Ser. No. 07/424,509, filed Oct. 20, 1989 now abandoned, showing the clearcut advantage of using the deformation slits 151 introduced in FIG. 3. With the substitution of flexibility for rigidity in the frontal plane, the shoe sole can duplicate virtually identically the natural deformation of the human foot, even when tilted to the limit of its normal range, as shown before in FIG. 2. The natural deformation capability of the shoe sole provided by the applicant's prior invention shown in FIG. 4 is in complete contrast to the conventional rigid shoe sole shown in FIG. 1, which cannot deform naturally and has virtually no flexibility in the frontal plane.

It should be noted that because the deformation sipes shoe sole invention shown in FIGS. 3 and 4, as well as other structures shown in the '509 application and in this application, allows the deformation of a modified conventional shoe sole to parallel closely the natural deformation of the barefoot, it maintains the natural stability and natural, uninterrupted motion of the barefoot throughout its normal range of sideways pronation and supination motion.

Indeed, a key feature of the applicant's prior invention is that it provides a means to modify existing shoe soles to allow them to deform so easily, with so little physical resistance, that the natural motion of the foot is not disrupted as it deforms naturally. This surprising result is possible even though the flat, roughly rectangular shape of the conventional shoe sole is retained and continues to exist except when it is deformed, however easily.

It should be noted that the deformation sipes shoe sole invention shown in FIGS. 3 and 4, as well as other structures shown in the '509 application and in this application, can be incorporated in the shoe sole-structures described in the applicant's pending U.S. application Ser. No. 07/469,313 still pending, as well as those in the applicant's earlier applications, except where their use is obviously precluded. Relative specifically to the '313 application, the deformation sipes can provide a significant benefit on any portion of the shoe sole that is thick and firm enough to resist natural deformation due to rigidity, like in the forefoot of a negative heel shoe sole.

Note also that the principal function of the deformation sipes invention is to provide the otherwise rigid shoe sole with the capability of deforming easily to parallel, rather than obstruct, the natural deformation of the human foot when load-bearing and in motion, especially when in lateral motion and particularly such motion in the critical heel area occurring in the frontal plane or, alternately, perpendicular to the subtalar axis, or such lateral motion in the important base of the fifth metatarsal area occurring in the frontal plane. Other sipes exist in some other shoe sole structures that are in some ways similar to the deformation sipes invention described here, but none provides the critical capability to parallel the natural deformation motion of the foot sole, especially the critical heel and base of the fifth metatarsal, that is the fundamental process by which the lateral stability of the foot is assured during pronation and supination motion. The optimal depth and number of the deformation sipes is that which gives the essential support and propulsion structures of the shoe sole sufficient flexibility to deform easily in parallel with the natural deformation of the human foot.

Finally, note that there is an inherent engineering trade-off between the flexibility of the shoe sole material or materials and the depth of deformation sipes, as well as their shape and number; the more rigid the sole material, the more extensive must be the deformation sipes to provide natural deformation.

FIGS. 5A–5D show close-up cross sections of shoe soles modified with the applicant's new inventions for deformation sipes; the sections are similar to FIGS. 3B–3D.

Figure 5A:
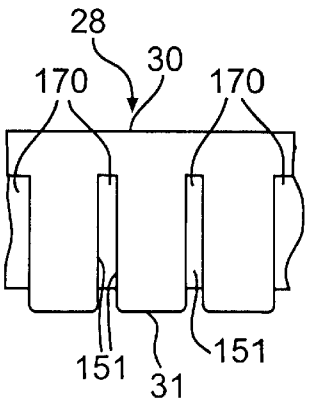
FIGS. 5A–5D show the applicant's new invention in close-up sections of the shoe sole similar to FIG. 3 to show various new forms of sipes, including both slits and channels; the figures are similar to FIGS. 3B–3E.
Figure 5B:
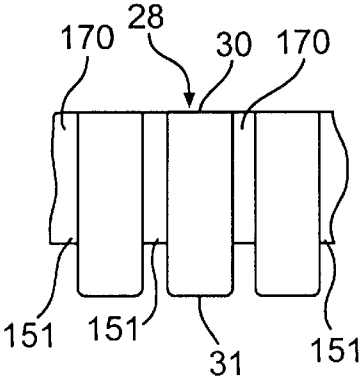

FIG. 5A shows a cross section of a new design with deformation sipes in the form of channels like that of FIG. 3D, but with most of the channels filled with a material 170 flexible enough that it still allows the shoe sole to deform like the human foot. FIG. 5B shows a similar cross section with the channel sipes extending completely through the shoe sole, but with the intervening spaces also filled with a flexible material 170 like FIG. 5A; a flexible connecting top layer 123 like that of FIG. 3E can also be used, but is not shown. As indicated before under FIG. 3, the relative size and shape of the sipes can vary almost infinitely. The relative proportion of flexible material 170 can vary, filling all or nearly all of the sipes, or only a small portion, and can vary between sipes in a consistent or even random pattern. As before, the exact structure of the sipes and filler material 170 can vary widely and still provide the same benefit, though some variations will be more effective than others. Besides the flexible connecting utility of the filler material 170, it also serves to keep out pebbles and other debris that can be caught in the sipes, allowing relatively normal bottom sole tread patterns to be created.

Figure 5C:
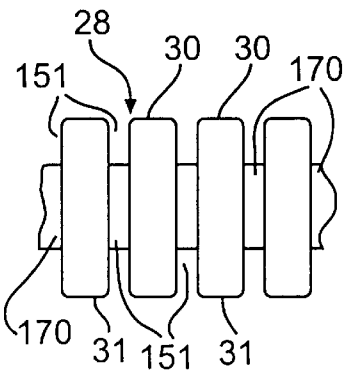

FIG. 5C shows a similar cross section of a new design with deformation sipes in the form of channels that penetrate the shoe sole completely and are connected by a flexible material 170 which does not reach the upper surface 30 of the shoe sole 28. Such an approach creates can create and upper shoe sole surface similar to that of Maseur sandals, but one where the relative positions of the various sections of the upper surface of the shoe sole will vary between each other as the shoe sole bends up or down to conform to the natural deformation of the foot. The shape of the channels should be such that the resultant shape of the shoe sole sections would be similar but rounder than those honeycombed shapes of FIG. 14D of the '509 application; in fact, like the Maseur sandals, cylindrical with a rounded or beveled upper surface is probably optimal. The relative position of the flexible connecting material 170 can vary widely and still provide the essential benefit. Preferably, the attachment of the shoe uppers would be to the upper surface of the flexible connecting material 170.

A benefit of the FIG. 5C design is that the resulting upper surface 30 of the shoe sole can change relative to the surface of the foot sole due to natural deformation during normal foot motion. The relative motion makes practical the direct contact between shoe sole and foot sole without intervening insoles or socks, even in an athletic shoe. This constant motion between the two surfaces allows the upper surface of the shoe sole to be roughened to stimulate the development of tough callouses (called a "seri boot"), as described at the end of FIG. 10 in the applicant's earlier '302 application, without creating points of irritation from constant, unrelieved rubbing of exactly the same corresponding shoe sole and foot sole points of contact.

Figure 5D:
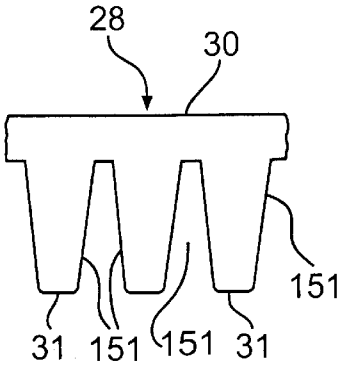

FIG. 5D shows a similar cross section of a new design with deformation sipes in the form of angled channels in roughly and inverted V shape. Such a structure allows deformation bending freely both up and down; in contrast deformation slits can only be bent up and channels with parallel side walls 151 generally offer only a limited range of downward motion. The FIG. 5D angled channels would be particularly useful in the forefoot area to allow the shoe sole to conform to the natural contour of the toes, which curl up and then down. As before, the exact structure of the angle channels can vary widely and still provide the same benefit, though some variations will be more effective than others. Finally, though not shown, deformation slits can be aligned above deformation channels, in a sense continuing the channel in circumscribed form.

Figure 6:
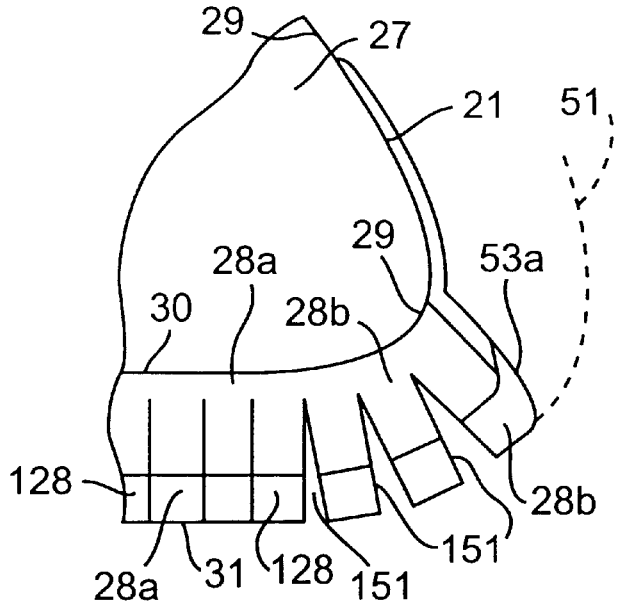
FIG. 6 is a view showing a portion of a cross section similar preceding figures, wherein the deformation slits applied in a new way to the applicant's prior naturally contoured sides invention, including the applicant's earlier invention of essential support elements.

FIG. 6 shows, in portions of frontal plane cross sections at the heel, the applicant's new invention for naturally contoured sides that can be attached to the sides of the conventional flat plane shoe sole, in accordance with the applicant's pending U.S. applications.

FIG. 6 shows the deformation sipes invention, in the form of slits, applied in a new way to the applicant's naturally contoured side invention, pending in U.S. application Ser. No. 07/239,667 now U.S. Pat. No. 5,317,819. FIG. 6 is similar to FIG. 9B of the pending U.S. application Ser. No. 07/424,509 now abandoned, but is preferable to that earlier figure.

As shown in FIG. 6, the contoured side deformation sipes can be cut as slits that then become V shaped channels when the shoe sole is bent up to be attached to shoe uppers which are contoured to fit standard shoe lasts; this approach was already demonstrated in FIGS. 10 and 11 of the '509 application. This is certainly the simplest approach. Alternatively, they can be cast during the injection molding process as V shaped channels within contoured sides that then become slits when the contoured sole side deforms to flatten during sideways foot motion, as shown later in the contoured side of FIG. 7 deforming into the flattened side of FIG. 8, both the fully contoured design. The advantage of the later approach is that the natural foot contour can be built into the contoured shoe sole with the casting process.

In FIG. 6, the applicant's deformation slit design is applied to the sole portion 28b in FIG. 4B, 4C, and 4D of the earlier '667 application, to which are added a portion of a naturally contoured side 28a, the outer surface of which lies along a theoretically ideal stability plane 51. FIG. 6 also illustrates the use of deformation slits 151 to facilitate the flattening of the naturally contoured side portion 28b, so that it can more easily follow the natural deformation of the wearer's foot in natural pronation and supination, no matter how extreme.

Figure 9:
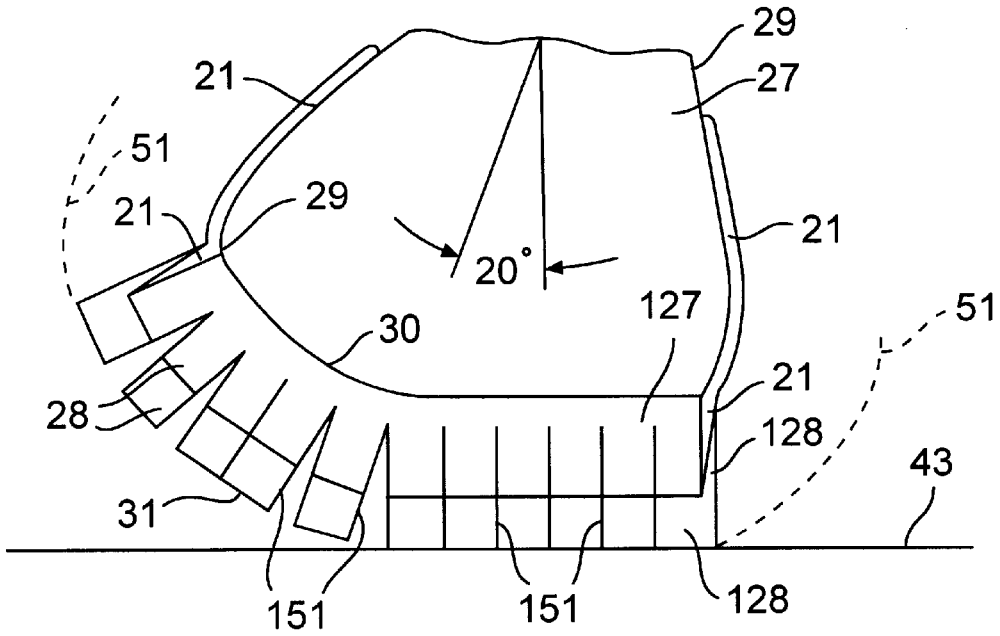
FIG. 9 shows a view like that of FIG. 4, but of the FIG. 8 design.

The deformation slits 151 approach can be used by themselves or in conjunction with the shoe sole construction and natural deformation outlined in FIG. 9 of pending U.S. application Ser. No. 07/400,714 still pending.

It should be noted that the naturally contoured side contour shown in FIG. 6 can be used only at those positions in the shoe sole that directly support the essential support and propulsion elements that were identified in the '667 application, such as the base of the fifth metatarsal, the heads of the metatarsals, and the first distal phalange, as well as the main and lateral tuberosities of the calcaneus.

Figure 7:
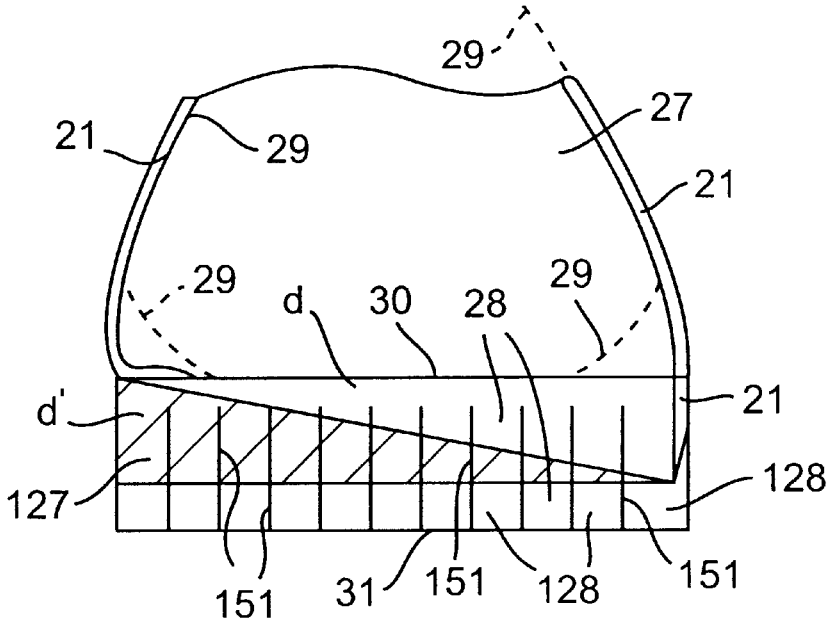
FIG. 7 shows in frontal plane cross section at the heel a shoe sole design in its undeformed state incorporating a new attachment approach for the shoe upper from pending application '509 and a multi-density midsole construction from pending application '714. The design shown deforms to the equivalent of the applicant's fully contoured prior invention, which conforms to the contour of the bottom of the foot, as well as the sides.
Figure 14:
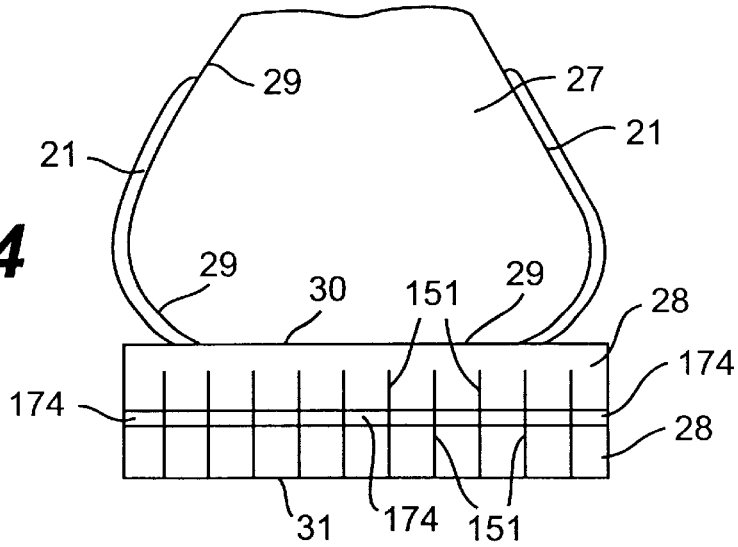
FIG. 14 shows deformation sipes applied to rigid shoe sole support structures, such as "dynamic reaction plates" and shanks.

FIG. 7 is similar to FIG. 10 of the applicant's pending '509 application on the shoe sole sipe invention which showed, again in a heel cross section, that the applicant's deformation slit invention can be applied to a conventional flat, roughly rectangular shoe sole in such a way as to transform it into a fully contoured sole like that illustrated in FIG. 14 of pending U.S. application Ser. No. 07/400,714 still pending, which is contoured underneath the foot as well as on its sides.

The new invention in FIG. 7 is the same as that outlined in FIG. 10 of Ser. No. 07/424,509 now abandoned, except that the shoe uppers 21 pass around the outside edge of the shoe midsole 127 to overlap and attach to the bottom sole 128, as shown on the right side, instead of to the very edge of the upper surface 30 of the shoe sole, as is conventional and shown on the left side. This new attachment invention is contained in pending U.S. application Ser. No. 07/463,302, filed on Jan. 10, 1990 still pending, provides superior natural lateral stability and is the preferred attachment technique. As shown superimposed on the outline of the wearer's heel before the shoe is put on, the shoe sole and upper do not match the outer surface of the human foot 29 as constructed; it matches the foot's shape only when put on the wearer.

FIG. 7 also shows the shoe sole density variation in the applicant's pending U.S. application Ser. No. 07/416,478, filed on Oct. 3, 1989 still pending. A right foot cross section, FIG. 7 shows the most common form of such variation, a firmer density (d1) in the midsole on the medial side to attempt to control excessive pronation and a lessor density (d) in the midsole on the lateral side; as noted in the '478 application, a roughly equivalent variation in shoe sole thickness with greater thickness on the medial side would produce about the same effect and can also benefit from the use of deformation sipes.

Note that deformation sipes can be applied, not only to convention flat shoe soles like that of FIG. 7 or to the contoured shoe soles of the '387, '667, '714, '478, '302, or '313 applications, but to any intermediate or partial contour between flat shoe soles conforming to the ground and naturally contoured shoe soles conforming fully or in part to the foot sole, deformed under load or undeformed without load.

Figure 8:
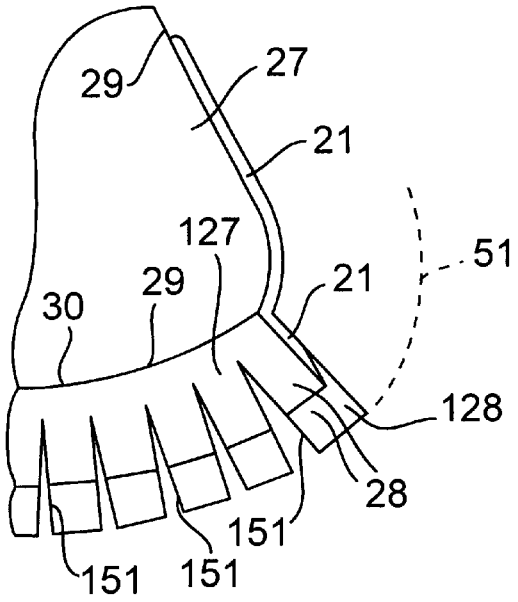
FIGS. 8 and 8A show a heel and forefoot frontal plane cross section of the attachment design on the wearer's unloaded foot, deforming easily to conform to its contours.
Figure 8A:
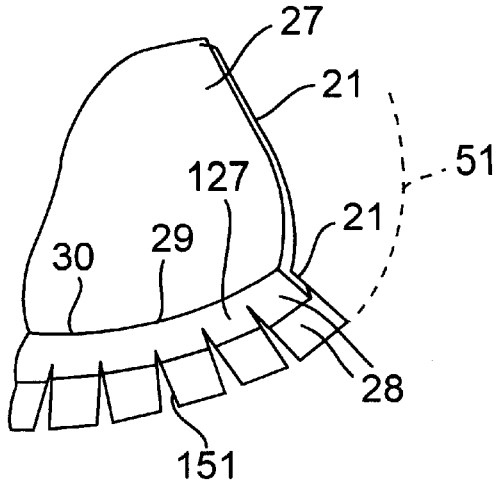

FIGS. 8 and 8A are similar to FIG. 11 of the applicant's pending application on the shoe sole sipe invention, Ser. No. 07/424,509 now abandoned, which showed that, when the shoe shown in FIG. 10 of the '509 application is on the wearer's foot, the extreme flexibility of its sole, created both by the deformation slits and by the outermost edge location of the shoe upper attachment to the shoe sole upper surface, allows the inner surface 30 of the shoe sole to follow very closely the natural contour of the surface 29 of the wearer's foot, including the bottom. It does so as if the shoe sole were custom made for each individual wearer within a standard size grouping; and the outer surface of the shoe sole will coincide with the theoretically ideal stability plane 51. Like FIG. 7, FIGS. 8 and 8A show the new attachment of the shoe upper overlapping and attaching to the bottom sole around the outside edge of the midsole.

It should be noted that the side portion of the fully contoured design shown in FIGS. 8 and 8A can be used only at those positions in the shoe sole that directly support the essential support and propulsion elements that were identified in the '667 application, such as the base of the fifth metatarsal, the heads of the metatarsals, and the first distal phalange, as well as the main and lateral tuberosities of the calcaneus.

FIG. 9 is like FIG. 4, but shows the new attachment invention of FIGS. 6 and 7; the heel frontal plane cross section is shown in full 20 degree inversion, where the advantage of the new attachment is greatest in avoiding artificial lever arm lateral instability. FIG. 9 shows that the key functional attribute of the deformation sipes design is that it allows a shoe with a conventional sole shape, like FIG. 7, to deform to the natural contour of the human foot, like FIGS. 8 and 8A, and to do so even when flattened during extremes of motion on the ground, as in FIG. 9. In doing so, the outer surface of the shoe sole parallels the outer surface of the foot sole, so that it coincides with the theoretically ideal stability plane, as defined in the '667 application. Consequently, FIG. 9 demonstrates that the deformation sipes invention allows a conventionally shaped shoe sole to deform to coincide with the theoretically ideal stability plane.

Figure 10C:
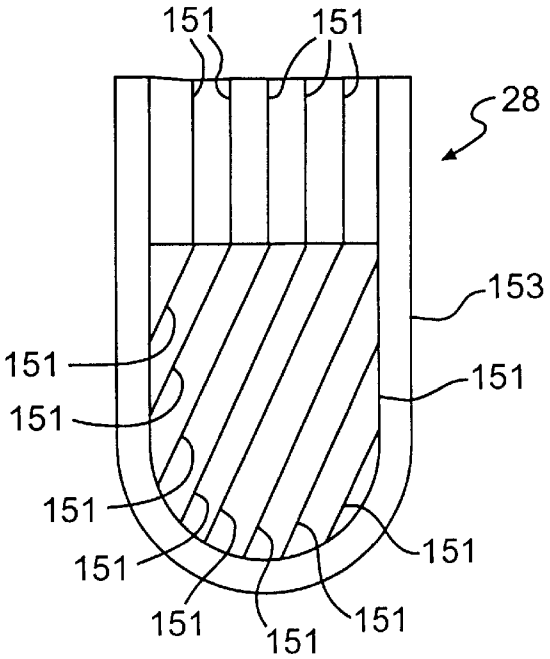
FIG. 10 shows several bottom views of the applicant's design in FIGS. 10A to 10C for shoe soles showing sample preferred patterns of deformation sipes such as slits.
FIG. 10D shows a typical path of center of pressure foot motion, to which deformation sipes can be oriented perpendicularly.
Figure 10B:
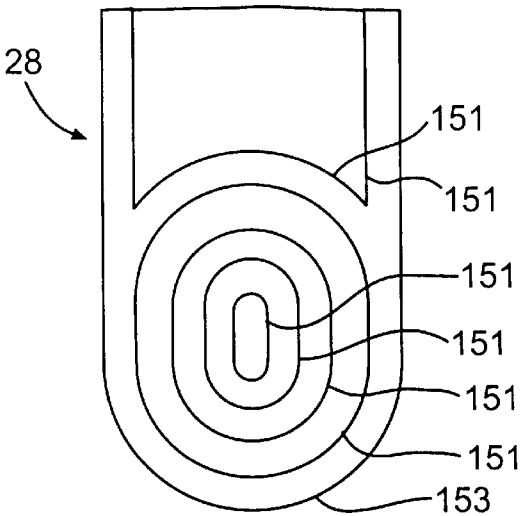
Figure 10A:
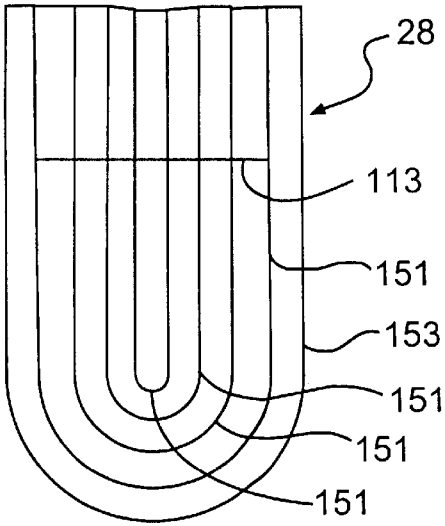

FIGS. 10A through 10C show bottom views of typical conventional show soles with preferred vertical plane pattern for deformation sipes such as channels or, as shown, slits; they are like FIGS. 13A–13D of the prior '509 application, which noted that all such patterns can exist alone or be superimposed over tread or cleat patterns; they can also coincide with tread or cleat patterns, in which case the most effective approach would likely be to mold in channels as the tread or cleats are cast, rather than cut slits. FIGS. 10A–C show heel portions of the shoe sole, where the sipes are most critical in normal shoe soles which have elevated heels relative to the forefoot, and the sipes can be used in only the heel area of such shoes, particularly in conventional street shoes, but the sipe patterns shown can be extended to some or all of the other portions of the shoe sole, such as the forefoot, which is important to do in athletic shoes, so that the maximum benefit can be obtained of achieving shoe sole deformation like that of the foot sole.

FIG. 10A shows all deformation sipes in the form of slits paralleling the outer edge 153 of the shoe sole 28 around the heel or all of its horizontal periphery, like the outermost slit 151 in FIG. 13B of the prior '509 application, which paralleled the outer edge 153 of the shoe sole 28 at the heel; as a result, all of the slits would remain interior to the outer edge 153 of the shoe sole and therefore none would be observable when the shoe is on the ground in its normal position, thus improving the conventional appearance of the shoe sole in the heel area, which would be important in a formal and traditional street or dress shoe. A key functional advantage of this approach is that the shoe sole can follow the natural deformation of the wearer's heel at the heel-strike phase of walking and running, and that it can do so in all vertical planes along the outer portion of the shoe sole, including the heel area, not just in the frontal plane. The deformation slits 151 in the heel area are separated from the more conventionally aligned deformation slits of the instep area by flexibility slit 113.

FIG. 10B shows deformation sipes in the form of slits 151 radiating out in parallel from the central support area directly under the calcaneus. The same pattern of deformation sipes could be repeated under the other essential support and propulsion structures of the foot, such as the base of the fifth metatarsal, the heads of the metatarsals, and the first distal phalanges, as well as the other distal phalanges and the lateral tuberosity of the calcaneus.

FIG. 10C shows deformation sipes in the form of slits 151 that are, in the heel area only, aligned with the approximately 25 degree axis of the subtalar joint, except for the outermost slit 151 which parallels the outer edge of the shoe sole 153, as in FIG. 10. They are separated from the more conventionally aligned deformation slits of the instep area by flexibility slit 113. Since the range of individual subtalar joint axis varies from roughly 5 to 50 degrees, axes within than range can be used for specific individuals or groups of individuals who have similar subtalar joint axes. The same would be true for the applicant's relevant earlier applications. Other sipes such as deformation slits or channels can be oriented along the joint axes of other essential support elements.

Figure 10D:
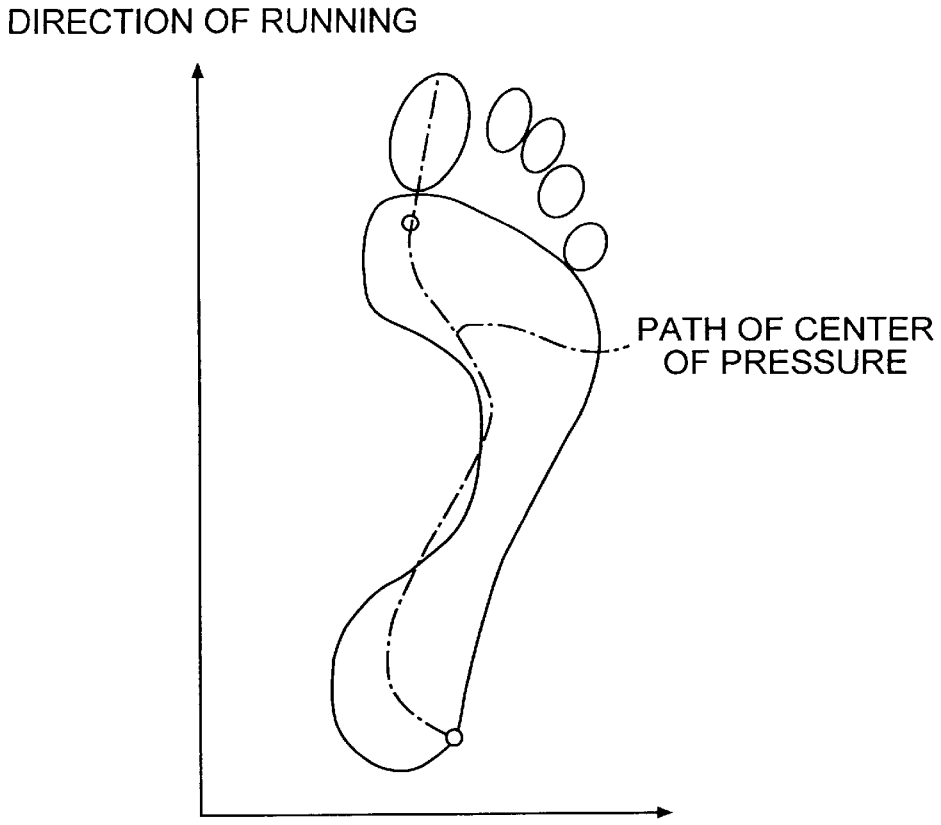

FIG. 10D shows a typical path of the center of pressure motion in the foot during running. Deformation sipes can be oriented perpendicular to such a path's corresponding position on the shoe sole to facilitate natural motion of the shoe sole with that of the foot. Such a path can be determined generally or for an individual or group of similar individuals.

It should be noted that the perpendicular intersecting lines pattern in the heel area shown in FIG. 13D of the '509 application, which were described there as particularly appropriate for the forefoot because that area requires multiplanar flexibility, may not be effective in the area under the calcaneus, since apparently unneeded flexibility in the sagittal plane there may actually reduce a shoe sole rigidity that promotes stability in the long arch of the foot by providing the human heel with firm structural support; some empirical testing is required to determine optimal configurations, which may in fact just be a case of correctly balancing shoe sole material flexibility with deformation sipe depth and spacing to achieve a construction that least obstructs the natural motion of the human foot.

Figure 11A:
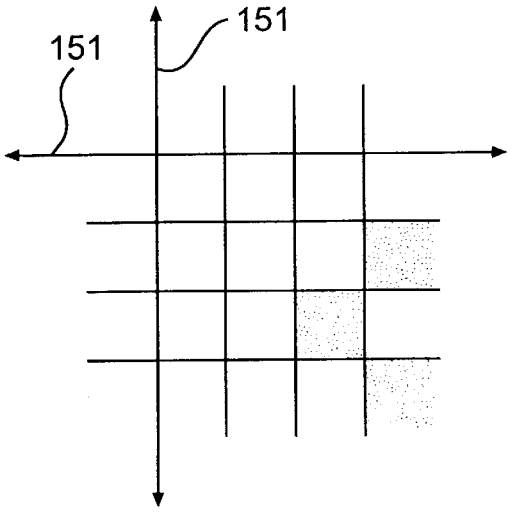
FIG. 11 shows from the applicant's prior '509 application several additional patterns of deformation sipes such as slits to provide multi-planar flexibility in FIGS. 11A and 11B.
Figure 11B:
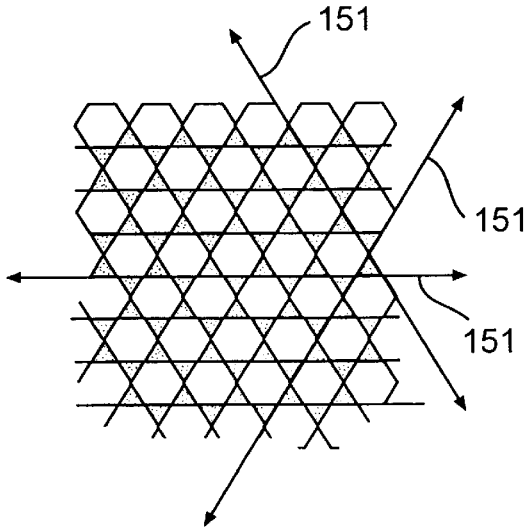

FIG. 11 shows a sample of intersecting patterns of straight line deformation sipes such channels or, as shown, slits 151. FIGS. 11A and 11B were FIGS. 14A and 14D in the applicant's prior '509 application. FIG. 11A shows simple 90 degree intersection, resulting in squares and providing optimal flexibility in two vertical planes. The angle of intersection of the straight lines, which can be curved or otherwise not straight, can vary, as can the distance between deformation slits, which can be even, or uneven but a periodically repeating sequence, or erratically spaced. The darkened squares indicate that shoe sole portions can be removed to provide tread or cleat-like shoe soles; this can be done regularly, as shown, or irregularly.

The text for FIG. 14D of the prior '509 application, repeated as FIG. 11B here, was inadvertently omitted. FIG. 11B shows that, like the removed squares mentioned in FIG. 11A (and in FIGS. 14B and 14C of the '509 application, but not repeated here), channels of any shape can be created to form the structure of the remaining shoe sole. Such structures can be regular and obvious, even if the structure and shape of the associated formative deformation sipes are complicated and less clearcut. In FIG. 11B, the resulting structures are regular hexagons.

Thus, in a sense, the shoe sole can be described in terms of the remaining structure of the shoe sole, rather than the structure of the deformation sipes; the difference is like that between a positive and negative photograph. On that basis, any shoe sole structure resulting from deformation sipes can equally as well be defined as intact structures themselves. For example, intersecting perpendicular deformation slits create a shoe sole structure in FIG. 11A that also can be defined as squares that radiate like whorls from the inner surface of the shoe sole, which coincides with the contoured surface of the foot sole, which is flattened during deformation. Any shape, whether regular like a circle or irregular, can have such a whorl structure relative to the upper surface of the shoe sole. Other whorl shoe sole structures were discussed earlier in FIG. 10 of the prior '302 application.

The range of possible beneficial variations for this whorl category of embodiment is quite large: for example, relatively thin cylindrical structures of typically relatively firm shoe sole material could be entirely embedded while aligned roughly perpendicular to the surfaces of the shoe sole in a flexible material 170. The resulting pattern or structure of the deformation sipes filled by flexible material would be extremely irregular and therefore difficult to describe, although the cylindrical whorl structures are quite simple. The resulting shoe sole with this structure possess the prime attribute of the applicant's '509 application: namely, steady support and firm protection for the foot, together with easy, natural flexibility in order to deform in parallel with the foot. Alternatively, it may even be technically possible to produce a shoe sole material of numerous firm particles relatively densely packed and suspended in a flexible connecting material 170 that would also possess this prime attribute.

In addition, it should be noted in reference to FIG. 11A that the two axes approach shown should be sufficient for most applications, since motion even at 45 degrees to the axes is facilitated by the sipes on those axes.

Figure 12:
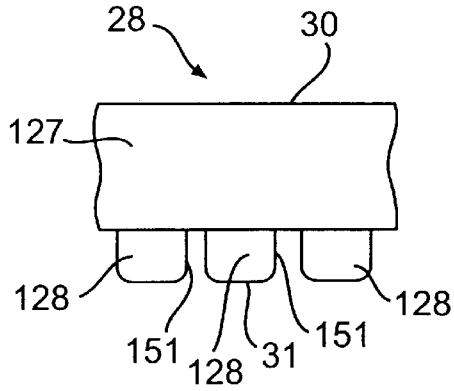
FIG. 12 shows the principles of the preceding figures applied to the bottom sole layer only, shown in close-up cross section.

FIG. 12 shows the same deformation slit 151 concept described heretofore applied to just the structure of shoe bottom soles, as was shown in FIG. 15 of the prior '509 application. The bottom soles of existing shoes, especially in the heel area, are relatively hard and thick to provide good wear characteristics, but because of that hardness and thickness, do not deform easily; this is particularly true of conventional street and dress shoes, of which all of the heel material is normally very firm.

FIG. 12 shows, in a close-up of a frontal plane cross section in the heel area like FIG. 15 of the '509 application, separate and unconnected sections of bottom sole 128 attached to midsole 127. Since bottom sole material is typically hard to promote wear, but consequently relatively undeformable, the separation of bottom sole sections allows the typically more pliable midsole to provide the necessary connection of bottom sole sections. The same approach can be applied to typical street and dress shoes, particularly their heels, although to be very conventional the hard sole area would be proportionately even much greater than shown in FIG. 12 and the midsole less; this arrangement is probably not optimal and would preferably employ the use of an outermost deformation sipe 151 paralleling the outer edge of the heel 153, like FIGS. 10A and 10C. The orientation of the deformation sipes, particularly in the critical heel area, should be as indicated in FIG. 10 here and in FIG. 13 of the prior '509 application, in contrast to just in the forefoot area along roughly the axis of the frontal plane, as is known to the art.

Figure 13:
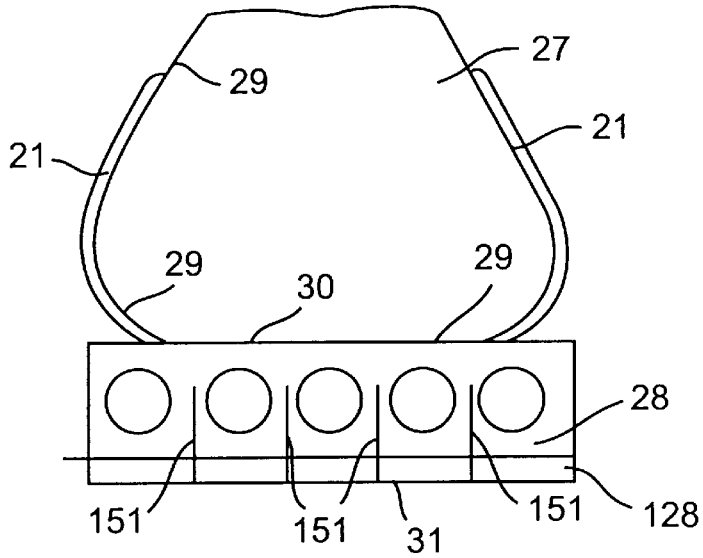
FIG. 13 shows deformation sipes applied to conventional gas-filled or hytrel tube cushioning devices, in frontal plane cross section at the heel.

FIG. 13 shows, in frontal plane cross section at the heel, the deformation sipes invention applied to conventional "air" sole cushioning devices, which as currently configured with a multiplicity of flexible connected tube shaped chambers, some of which are perpendicular to others, would be punctured by such sipes. To adapt to the general deformation sipes invention, such midsole gas-filled devices should preferably be unconnected tube-shaped chambers 172, located in parallel to the deformation sipes 151. Although the tube shape is probably optimal, other shapes can be used, such as those that conform more accurately to the shape of the shoe sole. This approach is also preferable for hytrel tube cushioning or energy return devices, although such tubes could simply be sliced by deformation sipes. Gas-filled tube-shaped midsole chambers could also be assembled, connected or unconnected, in parallel in a single chamber, as is generally the case now, especially in the heel area, and incorporated with a flexible bottom sole like that described in FIG. 12 or FIG. 15 of the '509 application, but this approach is not considered preferable.

FIG. 14 shows, also in frontal plane cross section at the heel, a conventional shoe sole incorporating both deformation sipes 151 in the form of slits and a rigid layer 174 located in the midsole such as a patented "dynamic reaction plate" to provide support and pronation control. Such a rigid layer 174 would obviously have to be penetrated by the deformation sipes 151 to allow the shoe sole to deform naturally in parallel with the foot's deformation. Any other such rigid device, whether located in the midsole or on top of it, such as a conventional shoe shank providing support to the long arch of the foot in the instep area or hybrid "torsion" athletic shoe shanks, must also be penetrated fully by deformation sipes in order for the shoe sole's deformation to parallel that of the foot. Since such shank devices are located roughly along the central sagittal plane axis of the shoe sole, the use of deformation sipes that do not penetrate or do not penetrate fully the relatively rigid shank will still provide a definite improvement over the same shoe sole without the sipes; the improvement will simply be less than if the sipes did penetrate the shank fully. If, however, such a rigid shank structure is moved to the lateral side of the shoe sole to a position where it can directly support the base of the fifth metatarsal (the one of the essential support elements identified in the '667 application that is not directly supported in conventional hollow instep street shoes), which is its optimal position, then the shank has an even greater requirement to be penetrated fully by deformation sipes, since its rigidity would otherwise promote lateral ankle sprains like conventional shoe sole do; of course, without such full penetration, deformation sipes still provide a distinct improvement over such a shoe sole without them.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A shoe comprising:

a shoe upper with flexible portions; and a shoe sole having a heel portion including a bottom sole and a midsole, at least a portion of the heel bottom sole portion includes sipe means for providing flexibility of the sole, said shoe sole portion having a contoured side portion with an upper concavely rounded surface and a lower concavely rounded surface such that at least a lateral part of the upper surface of said shoe sole heel portion deforms to conform to the shape of a curved side of a wearer's foot sole when said shoe is worn on said wearer's unloaded foot, as viewed in a frontal plane cross-section of the sole, the concavity existing with respect to the wearer's foot location in the shoe, wherein the sipe means originate at a ground-contacting surface of said sole and extend both in a shoe sole longitudinal direction and laterally beyond an adjacent side of the wearer's foot heel when the shoe is worn on the wearer's unloaded foot, and wherein the longitudinal extending sipe means extend into the contoured side portion of the sole.

2. The shoe as set forth in claim 1, wherein said shoe sole has a heel thickness greater than a forefoot thickness.

3. The shoe as set forth in claim 1, wherein said shoe sole deforms easily under body weight loads of a wearer when standing and during locomotion to conform to a shape of a body weight load-bearing wearer's foot sole, including its sides.

4. A shoe comprising:

a shoe upper with flexible portions;

a shoe sole having a heel portion including a bottom sole and a midsole, at least a portion of the heel bottom sole portion includes sipe means for providing flexibility of the sole, said shoe sole portion having a contoured side portion with an upper concavely rounded surface and a lower concavely rounded surface such that at least a lateral part of the upper surface of said shoe sole heel portion deforms to conform to the shape of a curved side of a wearer's foot sole when said shoe is worn on said wearer's unloaded foot, as viewed in a frontal plane cross-section of the sole, the concavity existing with respect to the wearer's foot location in the shoe, wherein the sipe means originate at a ground-contacting surface of said sole and extend both in a shoe sole longitudinal direction and laterally beyond an adjacent side of the wearer's foot heel when the shoe is worn on the wearer's unloaded foot, and wherein the longitudinal extending sipe means extend into the contoured side portion of the sole; and the shoe sole further includes a bottom layer, the flexible portions of the shoe upper are connected to said bottom layer of said shoe sole along an outer surface of said shoe sole, said flexible portions providing a tension force along an outside surface of said shoe during eversion and inversion motion of the wearer's foot, said flexible portions serving to control the eversion and inversion motion of the shoe sole, said motion paralleling that of the foot when bare, and said flexible portions ensuring that said shoe sole conforms to the shape of the wearer's foot sole, including at least portions of both the bottom and the sides.

5. The shoe as set forth in claim 4, wherein said contoured side portion is located at least at one of a base and a lateral tuberosity of the calcaneus of the wearer's foot.

6. A shoe sole comprising:

a shoe sole having a heel portion including a bottom sole and a midsole, at least a portion of the heel bottom sole portion includes sipe means for providing flexibility of the sole, said shoe sole portion having a contoured side portion with an upper concavely rounded surface and a lower concavely rounded surface such that at least inner part of the upper surface of said shoe sole portion conforms to at least a proximate curved part of a sole of a wearer's foot when said shoe is worn on said foot when unloaded, as viewed in a frontal plane cross-section of the sole, the concavity existing with respect to the wearer's foot location in the shoe, wherein the sipe means originate at a ground contacting surface of said sole and extend both in a shoe sole longitudinal direction and laterally beyond an adjacent side of the wearer's foot heel when the shoe is worn on the wearer's unloaded foot, and wherein the longitudinal extending sipe means extend into the contoured side portion of the sole.

7. The shoe sole as set forth in claim 6, wherein said contoured side portion is located at least at one of a base and a lateral tuberosity of the calcaneus of the wearer's foot.

8. The shoe sole as set forth in claim 6, wherein the shoe sole has a heel thickness greater than a forefoot thickness.

9. A shoe sole comprising:

a shoe sole having a heel portion including a bottom sole and a midsole, at least a portion of the heel bottom sole portion includes sipe means for providing flexibility of the sole, said shoe sole portion having a contoured side portion with an upper concavely rounded surface and a lower concavely rounded surface such that at least an inner part of the upper surface of said shoe sole portion conforms to at least a proximate curved part of a sole of a wearer's foot when said shoe is worn on said foot when unloaded, as viewed in a frontal plane cross-section of the sole, the concavity existing with respect to the wearer's foot location in the shoe, wherein the sipe means originate at a ground contacting surface of said sole and extend both in a shoe sole longitudinal direction and laterally beyond an adjacent side of the wearer's foot heel when the shoe is worn on the wearer's unloaded foot and wherein the longitudinal extending sipe means extend into the contoured side portion of the sole; and the shoe sole includes a bottom layer, at least portions of a flexible shoe upper are connected to said bottom layer of said shoe sole along an outer surface of said shoe sole;

said flexible shoe upper portions providing a tension force along the outside surface of said shoe during eversion and inversion motion of the wearer's foot;

said flexible shoe upper portions serving to control the eversion and inversion motion of the shoe sole, said motion paralleling that of the foot when bare;

and said flexible shoe upper portions ensuring that said shoe sole conforms to the natural shape of the wearer's foot sole, including at least portions of both the bottom and the sides.

* * * * *

UNITED STATES PATENT AND TRADEMARK OFFICE

CERTIFICATE OF CORRECTION

PATENT NO.: 6,115,945

ISSUED: September 12, 2000

INVENTOR: Frampton E. ELLIS, III

It is certified that an error appears in the above-identified patent and that said Letters Patent is hereby corrected as shown below:

Claim 6, column 14, line 55, before "inner," insert --an--.

Signed and Sealed this

First Day of May, 2001

*Attest:*

Nicholas P. Godici

NICHOLAS P. GODICI

*Attesting Officer*

*Acting Director of the United States Patent and Trademark Office*